US007124682B2

(12) United States Patent
Aoki

(10) Patent No.: US 7,124,682 B2
(45) Date of Patent: Oct. 24, 2006

(54) INTAGLIO PRINTING PRESS HAVING INTERCHANGEABLE INK FOUNTAIN UNIT AND PRE-WIPING UNIT

(75) Inventor: Toshiyuki Aoki, Noda (JP)

(73) Assignee: Komori Corporation, Tokyo (JP)

( * ) Notice: Subject to any disclaimer, the term of this patent is extended or adjusted under 35 U.S.C. 154(b) by 171 days.

(21) Appl. No.: 10/909,429

(22) Filed: Aug. 3, 2004

(65) Prior Publication Data

US 2005/0028693 A1 Feb. 10, 2005

(30) Foreign Application Priority Data

Aug. 8, 2003 (JP) ..... 2003-289599

(51) Int. Cl.
*B41F 9/02* (2006.01)
*B41F 9/08* (2006.01)
*B41F 31/20* (2006.01)

(52) U.S. Cl. ..... 101/155; 101/152; 101/175

(58) Field of Classification Search ..... 101/150, 101/151, 152, 153, 155, 157, 167, 170, 175, 101/176
See application file for complete search history.

(56) References Cited

U.S. PATENT DOCUMENTS 4,516,496 A 5/1985 Giori ..... 101/152
5,062,359 A 11/1991 Giori ..... 101/152
5,062,360 A * 11/1991 Germann et al. ..... 101/152

FOREIGN PATENT DOCUMENTS

JP 2001-96722 A 4/2001

* cited by examiner

*Primary Examiner*—Leslie J. Evanisko
(74) *Attorney, Agent, or Firm*—Birch, Stewart, Kolasch & Birch, LLP

(57) ABSTRACT

An intaglio printing press includes a rotatably supported intaglio cylinder, and a wiping roller and a wiping tank for removing excess ink from the intaglio cylinder. A rotatably supported fountain roller is provided. Wall plates and a bottom plate for supplying ink to the fountain roller, or an ink collection pan and a doctor blade for collecting ink through contact with the fountain roller is selectively provided. When the wall plates and the bottom plate are provided, the fountain roller supplies ink to the intaglio cylinder. When the ink collection pan and the doctor blade are provided, the fountain roller collects ink from the intaglio cylinder.

16 Claims, 12 Drawing Sheets

RELATED ART

INTAGLIO PRINTING PRESS HAVING INTERCHANGEABLE INK FOUNTAIN UNIT AND PRE-WIPING UNIT

CROSS REFERENCE TO RELATED APPLICATION

The entire disclosure of Japanese Patent Application No. 2003-289599 filed on Aug. 8, 2003 including specification, claims, drawings, and summary is incorporated herein by reference in its entirety.

BACKGROUND OF THE INVENTION

1. Field of the Invention

The present invention relates to an intaglio printing press.

2. Description of the Related Art

An intaglio printing press is configured as shown in FIG. 12 and functions as follows. A sheet feeder 10 feeds a sheet 1 onto a sheet feeder table 21. A swing arm shaft pregripper 22 transfers the sheet 1 to a transfer cylinder 23. The sheet 1 is then transferred to an impression cylinder 31 via a transfer cylinder 24. Ink fountain units 34*a* to 34*d* feed ink to an intaglio cylinder 32 via ink form rollers 33*a* to 33*d*, respectively. A wiping roller 37 removes excess ink from the intaglio cylinder 32, and then ink is transferred to the sheet 1 held on the impression cylinder 31 to thereby perform multicolor printing (4-color printing) on the sheet 1. Subsequently, the sheet 1 is transferred from the impression cylinder 31 to a delivery cylinder 41. The sheet 1 undergoes gripping change from the delivery cylinder 41 to a gripper bar of a chain 44. The sheet 1 is transported on the chain 44 as the chain 44 is run by means of rotation of sprockets 42 and 43. The thus-printed sheets 1 are delivered onto delivery units 45. (Refer to, for example, Japanese Patent Application Laid-Open (kokai) No. 2001-096722).

In such an intaglio printing press, as many ink fountain units and ink form rollers as possible; specifically, four ink fountain units 34*a* to 34*d* and four ink form rollers 33*a* to 33*d*, are disposed around the intaglio cylinder 32 to perform printing in as many colors as possible; specifically, in four colors. Notably, multicolor printing (4-color printing) making use of all of the ink fountain units 34*a* to 34*d* and the ink form rollers 33*a* to 33*d* is not performed very frequently. In most cases, ordinary printing (3-color printing) is performed by use of, for example, the ink fountain units 34*a* to 34*c* among the ink fountain units 34*a* to 34*d*, and the ink form rollers 33*a* to 33*c* among the ink form rollers 33*a* to 33*d*.

In the above-mentioned intaglio printing press, excess ink to be removed from the intaglio cylinder 32 by means of the wiping roller 37 is of a relatively large amount. Thus, a wiping liquid, contained in a wiping tank 38, used to clean the wiping roller 37 becomes unclean in a relatively short period of time, thereby increasing the frequency of replacing the wiping liquid, the frequency of regenerating the wiping liquid, or the frequency of a like operation. A conceivable measure to cope with the problem is to provide a pre-wiping unit upstream of the wiping roller 37 with respect to the rotational direction of the intaglio cylinder 32 to scrape most of excess ink from the intaglio cylinder 32, thereby slowing down contamination of the wiping liquid and thus reducing the frequency of replacing the wiping liquid, the frequency of regenerating the wiping liquid, or the frequency of a like operation.

However, since as many ink fountain units and ink form rollers as possible; specifically, the ink fountain units 34*a* to 34*d* and the ink form rollers 33*a* to 33*d*, are disposed around the intaglio cylinder 32, a space for disposing the pre-wiping unit is not available around the intaglio cylinder 32. In order to dispose the pre-wiping unit, the ink fountain unit 34*d* and the ink form roller 33*d*, which are the ink fountain unit and the ink form roller located furthest downstream with respect to the rotational direction of the intaglio cylinder 32, must be removed.

Thus, when a user is to purchase an intaglio printing press, the user has no other choice but to select either an intaglio printing press that performs ordinary printing (3-color printing) with pre-wiping, or an intaglio printing press that performs multicolor printing (4-color printing) without pre-wiping.

SUMMARY OF THE INVENTION

In view of the foregoing, an object of the present invention is to provide an intaglio printing press capable of performing both multicolor printing (4-color printing) without pre-wiping and ordinary printing (3-color printing) with pre-wiping.

To achieve the above object, the present invention provides an intaglio printing press, comprising: a rotatably supported intaglio cylinder; and wiping means for removing excess ink from the intaglio cylinder; a rotatably supported roller; one of an ink fountain for supplying ink to the roller, and pre-wiping means for collecting ink through contact with the roller provided selectively, wherein, when the ink fountain is provided, the roller supplies ink to the intaglio cylinder, and when the pre-wiping means is provided, the roller collects ink from the intaglio cylinder.

The above intaglio printing press further comprises a support member that selecting supports one of the ink fountain and the pre-wiping means. In this case, preferably, the ink fountain and the pre-wiping means use the same attachment structure for attachment to the support member. More preferably, the attachment structure includes a lock bolt extending through the support member and engaged with one of the ink fountain and the pre-wiping means, and a lock screw engaged with a groove formed in one of the ink fountain and in the pre-wiping means, and screw-engaged with the support member. In this case, further preferably, the attachment structure further includes a fixing bolt extending through one of the ink fountain and the pre-wiping means and screw-engaged with the support member.

In the case where one of the ink fountain and the pre-wiping means is selectively supported by the support member, preferably, the support member is a support bed supported in a pivotally movable condition by a frame of the intaglio printing press. In this case, preferably, the intaglio printing press further comprises first support-bed-retaining means for, when the ink fountain is provided on the support bed, retaining the ink fountain at a position where ink is supplied from the ink fountain to the roller; and second support-bed-retaining means for, when the pre-wiping means is provided on the support bed, retaining the pre-wiping means at a position where ink is collected from the roller. More preferably, the pre-wiping means includes a blade for scraping ink from the roller through contact with the roller, and an ink collection pan for collecting ink scraped off by means of the blade, the second support-bed-retaining means includes a rotatably supported shaft, and an eccentric sleeve unitarily fitted to the rotative shaft and adapted to support the support bed thereon, and the blade adapted to be moved toward or away from the roller for positional adjustment by means of rotation of the rotative shaft.

In the intaglio printing press according to the present invention, preferably, the pre-wiping means includes a blade for scraping ink from the roller through contact with the roller, and an ink collection pan for collecting ink scraped off by means of the blade. In this case, preferably, the ink collection pan is supported in such a manner as to be removable from the blade. More preferably, the pre-wiping means further includes an attachment bed unitarily provided with the blade and having a front-end engagement portion and a rear-end engagement portion. A front end portion of the ink collection pan is removably engaged with the front-end engagement portion. A rear end portion of the ink collection pan is removably engaged with the rear-end engagement portion.

In the intaglio printing press according to the present invention, preferably, the intaglio printing press has a printing point and an ink supply/collection point. The printing point is located downstream of the wiping means with respect to the rotational direction of the intaglio cylinder. At the printing point, printing is performed. The ink supply/collection point is located on the intaglio cylinder and downstream of the printing point with respect to the rotational direction of the intaglio cylinder. At the supply/collection point, when the ink fountain is provided, the roller supplies ink to the intaglio cylinder, and when the pre-wiping means is provided, the roller collects ink from the intaglio cylinder. The intaglio printing press further comprises ink supply means provided downstream of the printing point and upstream of the ink supply/collection point with respect to the rotational direction of the intaglio cylinder.

In the intaglio printing press according to the present invention, preferably, the intaglio printing press further comprises a plurality of ink supply means provided upstream of the wiping means with respect to the rotational direction of the intaglio cylinder and adapted to supply ink to the intaglio cylinder; and ink means provided downstream of the ink supply means located furthest downstream with respect to the rotational direction of the intaglio cylinder, and upstream of the wiping means with respect to the rotational direction of the intaglio cylinder. The ink means is configured such that when the ink fountain is provided the roller supplies ink to the intaglio cylinder, and such that when the pre-wiping means is provided the roller collects ink from the intaglio cylinder.

In the intaglio printing press according to the present invention, preferably, the intaglio printing press further comprises a collective ink cylinder provided upstream of the wiping means with respect to the rotational direction of the intaglio cylinder; a plurality of ink supply means for supplying ink to the intaglio cylinder via the collective ink cylinder; and ink means provided downstream of the collective ink cylinder and upstream of the wiping means with respect to the rotational direction of the intaglio cylinder. The ink means is configured such that when the ink fountain is provided the roller supplies ink to the intaglio cylinder, such that when the pre-wiping means is provided the roller collects ink from the intaglio cylinder.

In the case of the intaglio printing press according to the present invention, preferably, three ink supply means are provided.

In the intaglio printing press according to the present invention, preferably, the intaglio cylinder is a triple-diameter cylinder.

The above-mentioned intaglio printing press of the present invention can perform multicolor printing without pre-wiping and fewer-color printing with pre-wiping, so that, when a user is to purchase an intaglio printing press, the user does not need to select from an intaglio printing press that performs multicolor printing without pre-wiping and an intaglio printing press that performs fewer-color printing with pre-wiping.

Thus, the intaglio printing press of the present invention is very usefully applicable to the printing industry.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of an intaglio printing press according to the present invention will next be described in detail with reference to the drawings.

Figure 1:
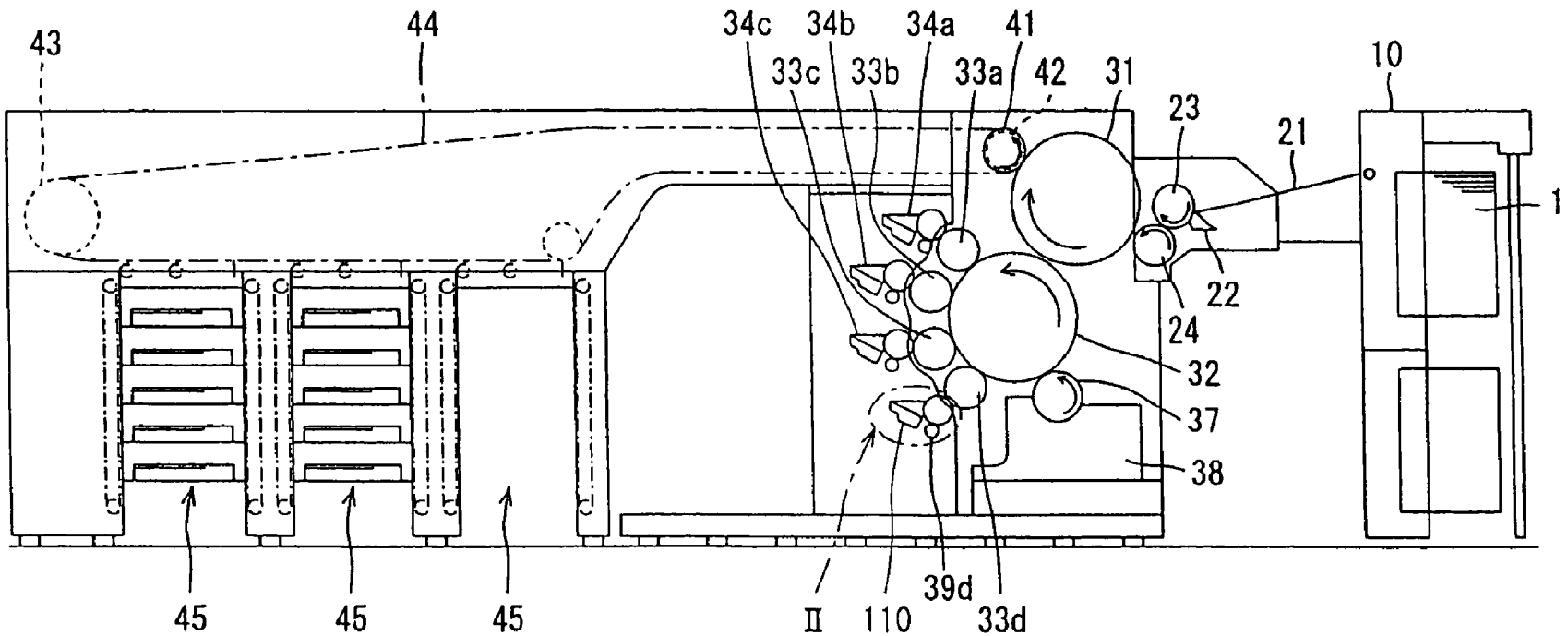
FIG. 1 is a schematic view showing the configuration of an embodiment of an intaglio printing press according to the present invention.

As shown in FIG. 1, a proximal end of a sheet feeder table 21 is connected to a sheet feeder 10, which feeds stacked sheets 1 one by one. A swing arm shaft pregripper 22 is provided on the distal-end side of the sheet feeder table 21 and transfers the sheet 1 to an unillustrated gripper unit provided on a transfer cylinder 23.

The transfer cylinder 23 is in contact with a transfer cylinder 24 having an unillustrated gripper unit. The transfer cylinder 23 is adapted to transfer the sheet 1 held by its gripper unit to the gripper unit of the transfer cylinder 24. The transfer cylinder 24 is in contact with a triple-diameter impression cylinder 31 and is adapted to transfer the sheet 1 held by its gripper unit to an unillustrated gripper unit of the impression cylinder 31.

A triple-diameter intaglio cylinder 32 is in contact with the impression cylinder 31 at a position located downstream of the transfer cylinder 24 with respect to the rotational direction of the impression cylinder 31. The position serves as a printing point. Four ink form rollers 33*a* to 33*d* are provided downstream of the impression cylinder 31 with respect to the rotational direction of the intaglio cylinder 32 and are in contact with the intaglio cylinder 32 while being arranged at predetermined intervals along the circumferential direction of the intaglio cylinder 32. Three ink fountain units 34*a* to 34*c* are in contact with the corresponding ink form rollers 33*a* to 33*c* in order to supply ink to the intaglio cylinder 32 via the ink form rollers 33*a* to 33*c*. The three ink fountain units 34*a* to 34*c* serve as three ink supply means according to the present invention.

A wiping roller 37 is in contact with the intaglio cylinder 32 at a position located downstream of the ink form roller 33*d* with respect to the rotational direction of the intaglio cylinder 32. A lower portion of the wiping roller 37 is immersed in a wiping liquid contained in a wiping tank 38. A delivery cylinder 41 is in contact with the impression cylinder 31 at a position located downstream of the intaglio cylinder 32 with respect to the rotational direction of the impression cylinder 31. The delivery cylinder 41 functions cooperatively with rotatably provided sprockets 42 and 43.

The sprockets 42 and 43 are provided with unillustrated corresponding chain guides. An endless chain 44 is looped around and mounted on the sprockets 42 and 43. A plurality of unillustrated gripper bars are attached to the chain 44 while being arranged at predetermined intervals along the traveling direction of the chain 44. The gripper bars receive the sheets 1 from the gripper units of the impression cylinder 31. Delivery units 45, which serve as accumulation means, are provided under the chain 44.

In the present embodiment, the wiping roller 37, the wiping tank 38, and other members constitute wiping means according to the present invention.

An ink unit 110, which serves as ink means according to the present invention, is disposed downstream of the ink fountain unit 34*c*, which is the ink fountain unit located furthest downstream with respect to the rotational direction of the intaglio cylinder 32, and upstream of the wiping roller 37 with respect to the rotational direction of the intaglio cylinder 32. The ink unit 110 indirectly abuts the intaglio cylinder 32 via the ink form roller 33*d*. A position where the ink form roller 33*d* and the intaglio cylinder 32 contact serves as an ink supply/collection point. The ink unit 110 is located in the vicinity of the wiping roller 37 (no other member is present on the circumferential surface of the intaglio cylinder 32 in a region between the ink unit 110 and the wiping roller 37) and is configured as shown in FIGS. 2 to 9.

As shown in FIGS. 2 to 5, an ink fountain roller 111, which serves as a roller according to the present invention, is in contact with the ink form roller 33*d*, which is the ink form roller located furthest downstream with respect to the rotational direction of the intaglio cylinder 32. The ink fountain roller 111 is rotatably supported by movable frames 112. The movable frames 112 can slide along corresponding guide members 112*a*, which are bolted to corresponding frames 110*a* of an intaglio printing press, such that the ink fountain roller 111 moves in a radial direction of the ink form roller 33*d* (in the A–B direction in FIG. 2).

A support bed 113, which serves as a support member according to the present invention, is located in the vicinity of the ink fountain roller 111 and is supported by the movable frames 112 in a pivotally movable condition via a support shaft 114. Wall plates 115 are disposed on the support bed 113 at corresponding widthwise opposite ends. The wall plates 115 are removably attached to the support bed 113 by means of fixing bolts 116, which extend through the wall plates 115 and are screw-engaged with the support bed 113. A bottom plate 117 is disposed on the support bed 113 between the wall plates 115.

Flange plates 118 are fixed to the proximal end of the bottom plate 117. Each of the flange plates 118 has a U-shaped groove 118*a*. The bottom plate 117 is removably attached onto the support bed 113 as follows: lock screws 119, which are screw-engaged with the support bed 113, are engaged with the corresponding U-shaped grooves 118*a*; and lock bolts 120, which extend through the support bed 113 from underneath, are engaged with the bottom surface of the bottom plate 117. Adjustment screws 121 are provided on the support bed 113 and used to adjust the clearance between the distal end of the bottom plate 117 and the ink fountain roller 111.

A rotative shaft 122 is located in the vicinity of the support bed 113 and is rotatably supported by the movable frames 112 via corresponding bearings. Eccentric sleeves 123 are unitarily fitted to the rotative shaft 122. Each of the eccentric sleeves 123 is formed such that the end of an operation rod 124 can be removably fitted into the outer surface of the eccentric sleeve 123. The operation rod 124 can also be removably fitted into a hole 113*a* formed in the support bed 113.

Meanwhile, as shown in FIGS. 6 to 9, an ink collection pan 131 is disposed on the support bed 113 from which the wall plates 115 and the bottom plate 117 have been removed. Flanges 132 having bolt holes formed therein are fixed to corresponding widthwise opposite ends of the ink collection pan 131. Flange plates 133 each having a U-shaped groove 133*a* formed therein are fixed to the proximal end of the ink collection pan 131.

The ink collection pan 131 is removably attached onto the support bed 113 as follows: the fixing bolts 116, which are also used to fix the wall plates 115 onto the support bed 113, extend through the flanges 132 and are screw-engaged with the support bed 113; the lock screws 119, which are screw-engaged with the support bed 113, are engaged with the corresponding U-shaped grooves 133*a*; and the lock bolts 120, which extend through the support bed 113 from underneath, are engaged with the bottom surface of the ink collection pan 131.

A doctor blade 134, which serves as a blade according to the present invention, is attached to the distal end of the ink collection pan 131. The doctor blade 134 abuts the outer circumferential surface of the ink fountain roller 111 so as to scrape adhering excess ink from the ink fountain roller 111.

Figure 4:
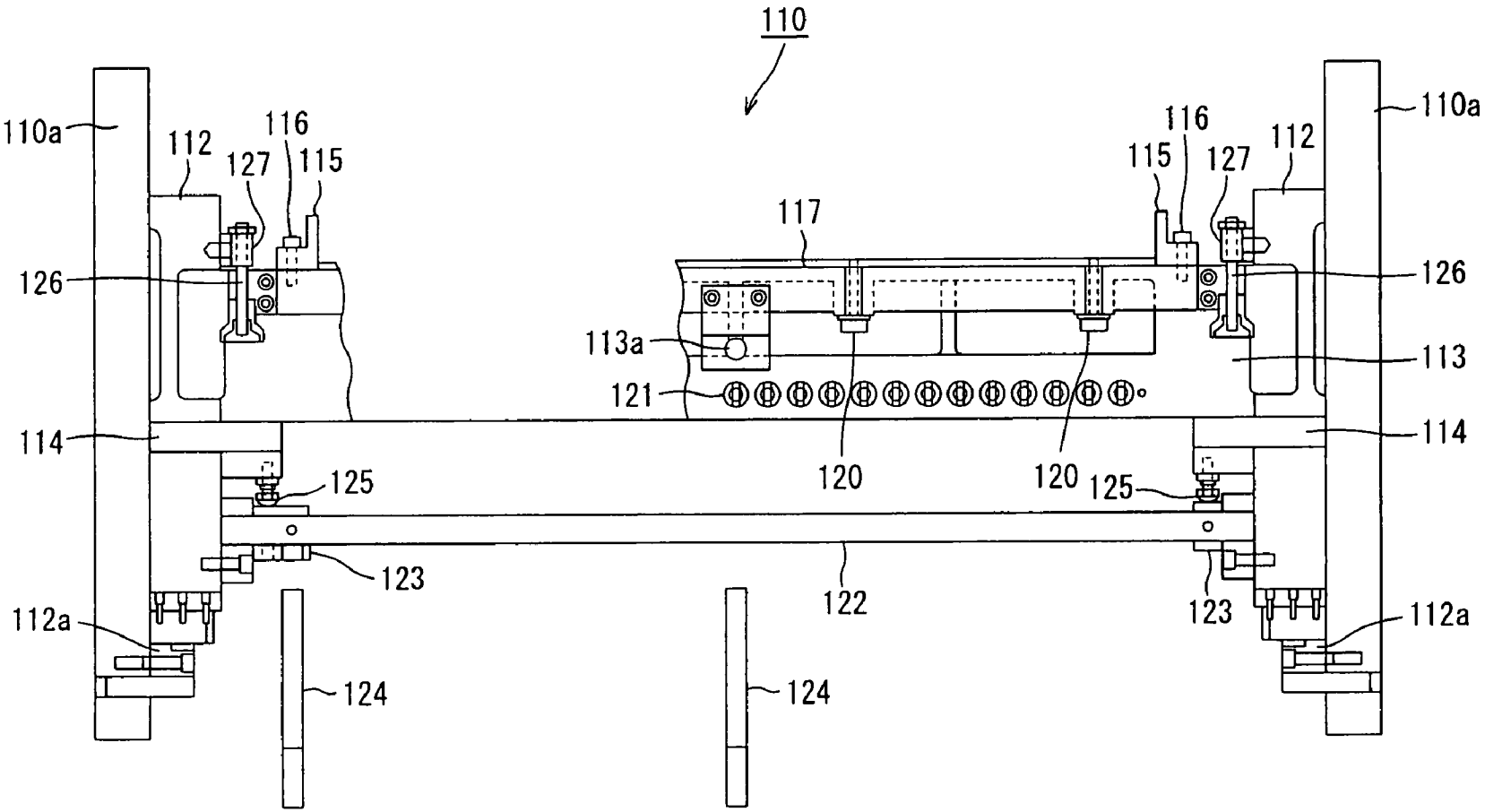
FIG. 4 is a rear view of FIG. 3.
Figure 5:
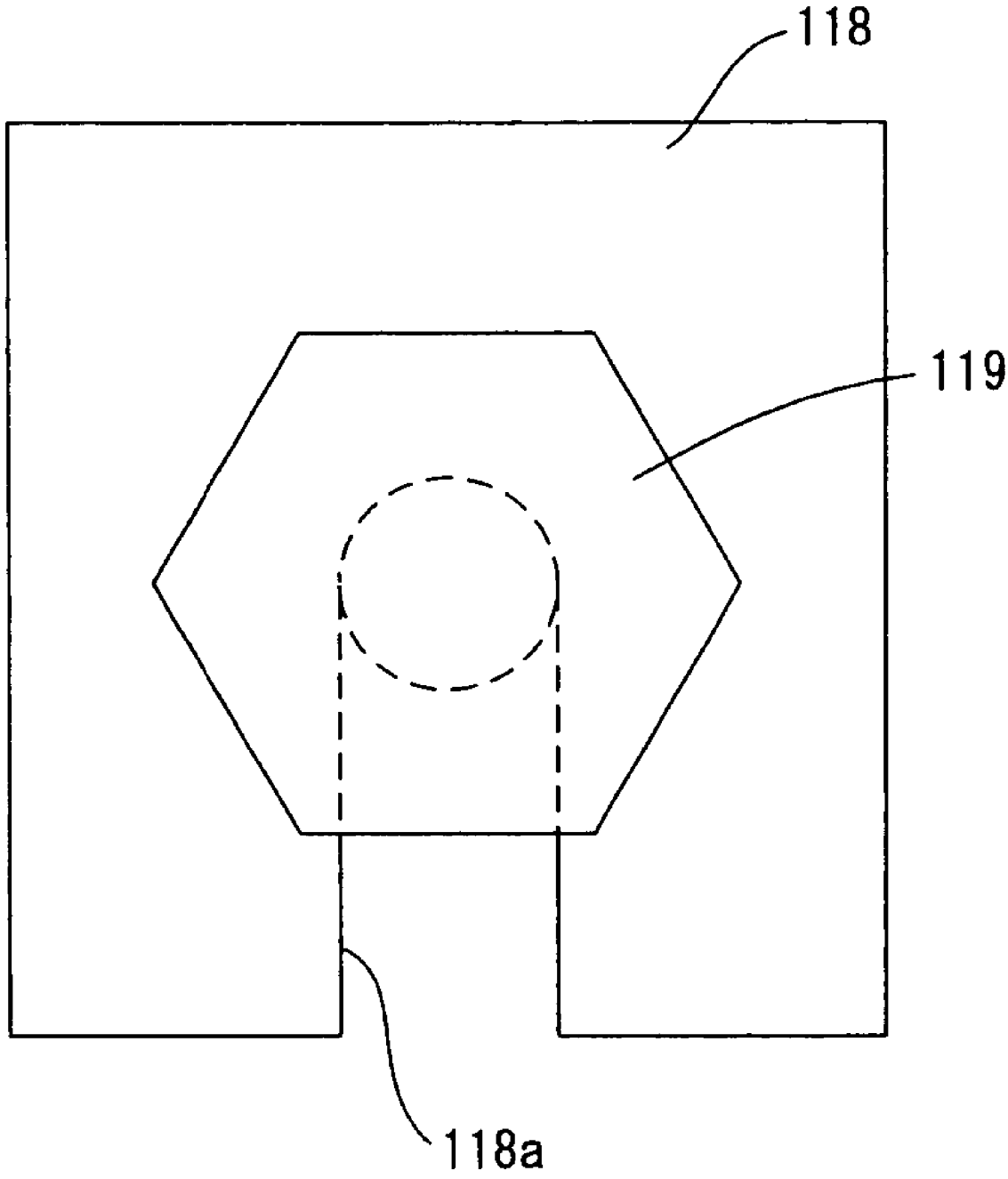
FIG. 5 is a view as viewed in the direction of arrow V of FIG. 3.

As shown in FIG. 4, position-fixing screws 126 extend through corresponding widthwise opposite end portions of the support bed 113. The position-fixing screws 126 are screw-engaged with corresponding female-threaded members 127, which are rotatably provided on the corresponding movable frames 112 at corresponding predetermined positions. In this manner, the support bed 113 can be fixed such that the upper surface of the support bed 113 is set at a predetermined angular position (at a predetermined angle of inclination).

In the case where the wall plates 115 and the bottom plate 117 are attached onto the support bed 113, the operation rod 124 is fitted into the hole 113*a* of the support bed 113. Then, by use of the fitted operation rod 124, the support bed 113 is pivotally moved about the support shaft 114 to incline its upper surface to a predetermined major angular position (a position for supplying ink to the ink fountain roller 111). The position-fixing screws 126 are screw-engaged with the corresponding female-threaded members 127, thereby fixedly retaining the support bed 113 at the inclined position and thus facilitating supply of ink to the ink fountain roller 111.

In the case where the ink collection pan 131 is attached onto the support bed 113, the operation rod 124 is fitted into the hole 113*a* of the support bed 113. Then, by use of the fitted operation rod 124, the support bed 113 is pivotally moved about the support shaft 114 to incline its upper surface to a predetermined minor angular position (a position for collecting ink from the ink fountain roller 111), whereby the support bed 113 is caused to rest on the outer surfaces of the sleeves 123 via bolts 125. Such positioning of the ink collection pan 131 facilitates collection of ink from the ink fountain roller 111.

Figure 2:
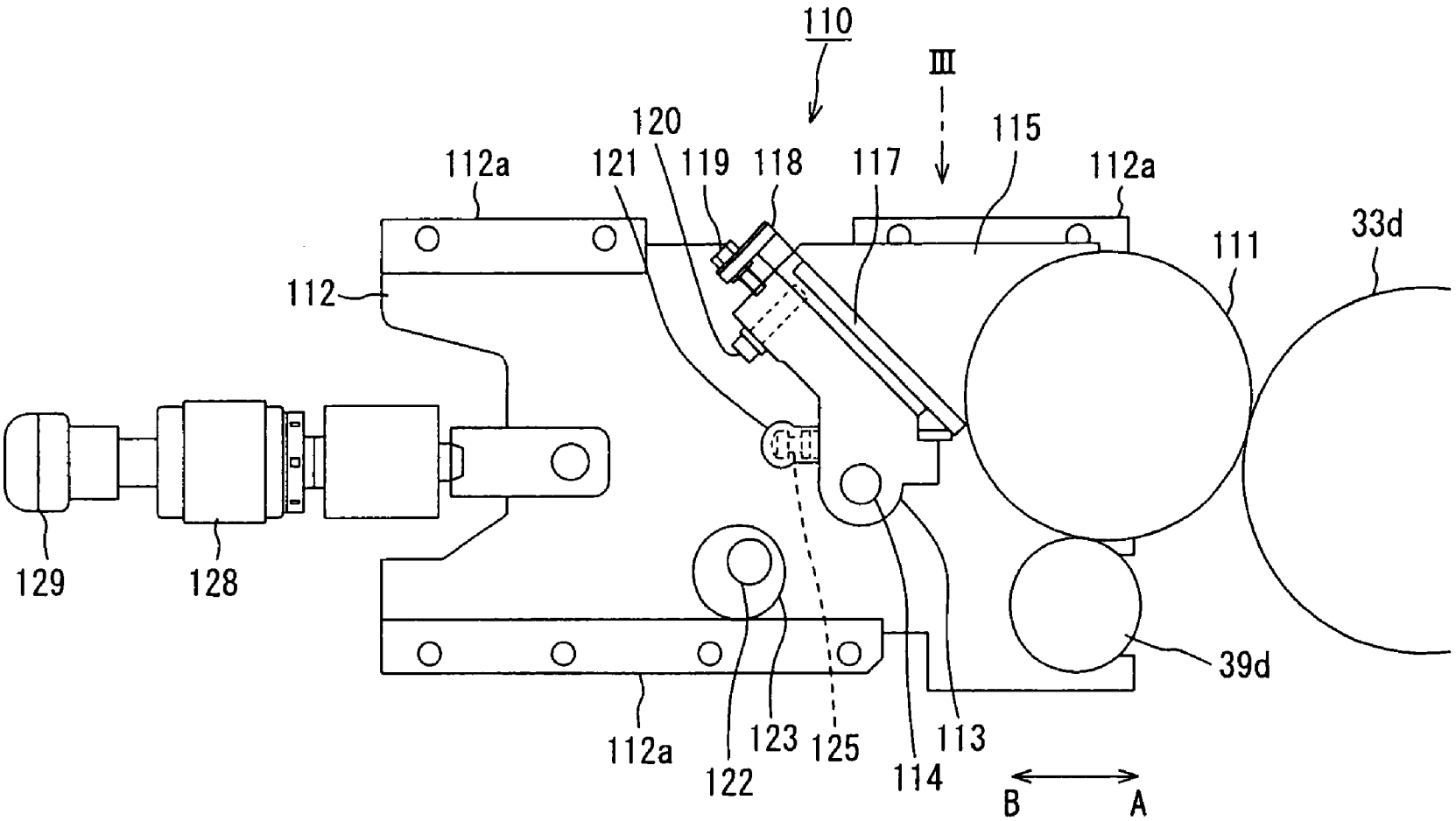
FIG. 2 is an enlarged view showing a region indicated by arrow II of FIG. 1.
Figure 3:
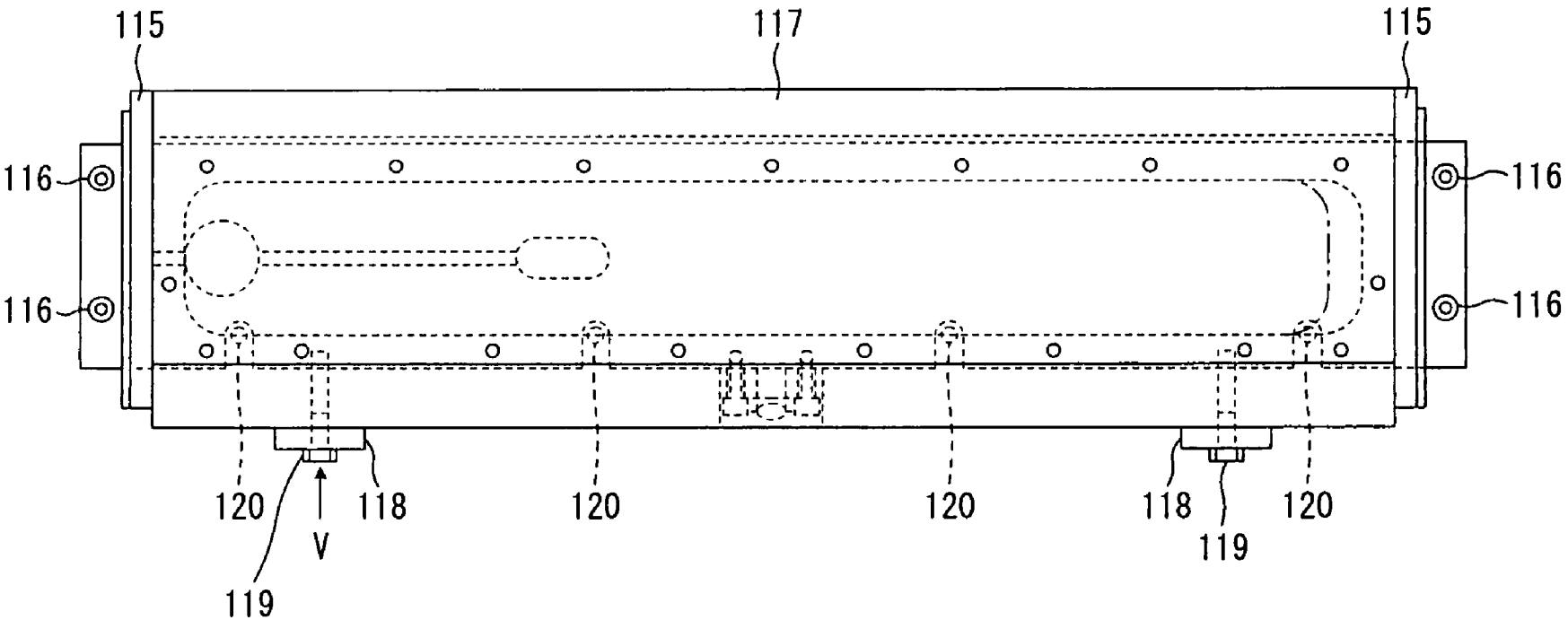
FIG. 3 is a view as viewed in the direction of arrow III of FIG. 2.
Figure 6:
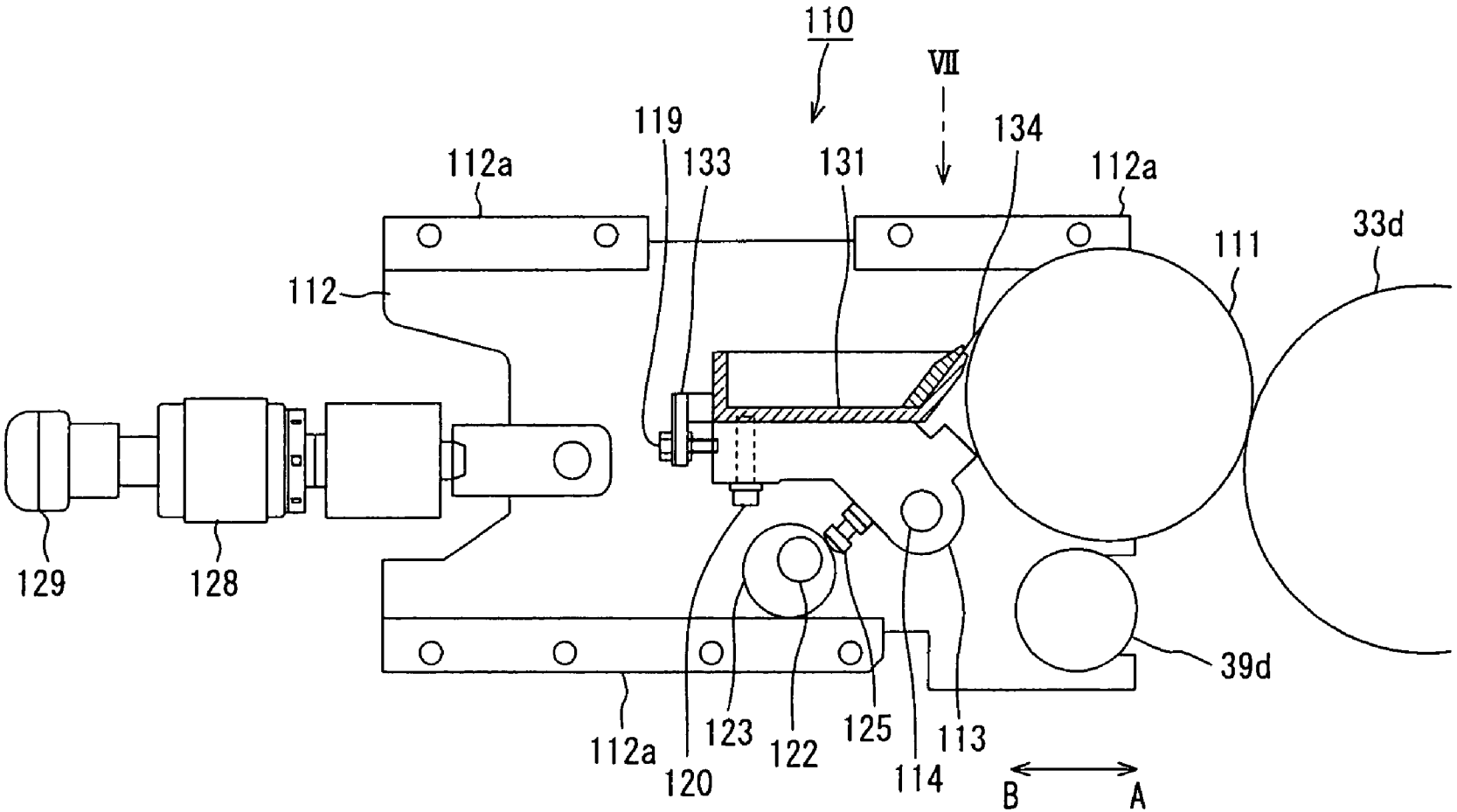
FIG. 6 is an enlarged view showing a region indicated by arrow II of FIG. 1 in the case where pre-wiping means is provided.
Figure 7:
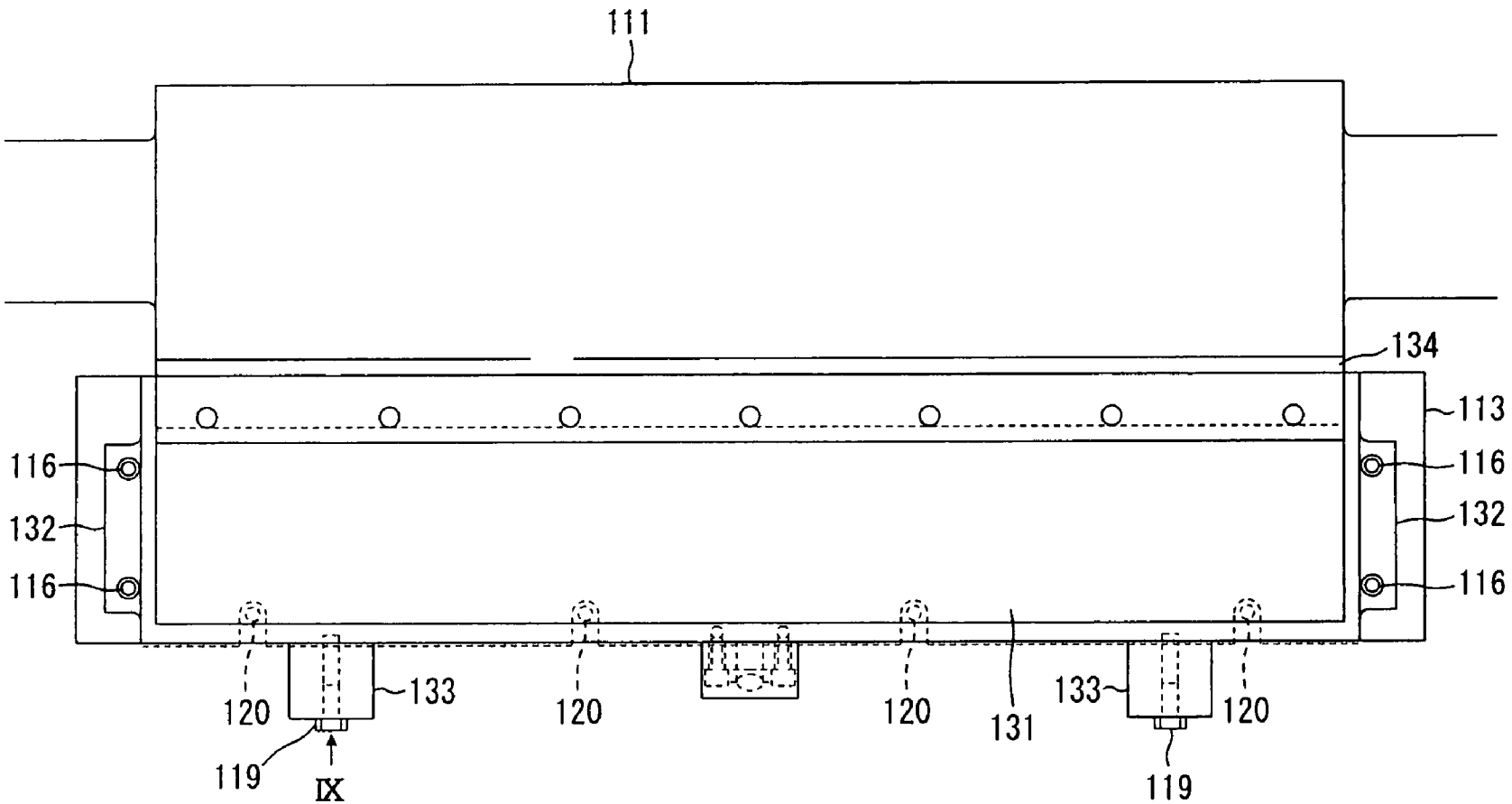
FIG. 7 is a view as viewed in the direction of arrow VII of FIG. 6.
Figure 8:
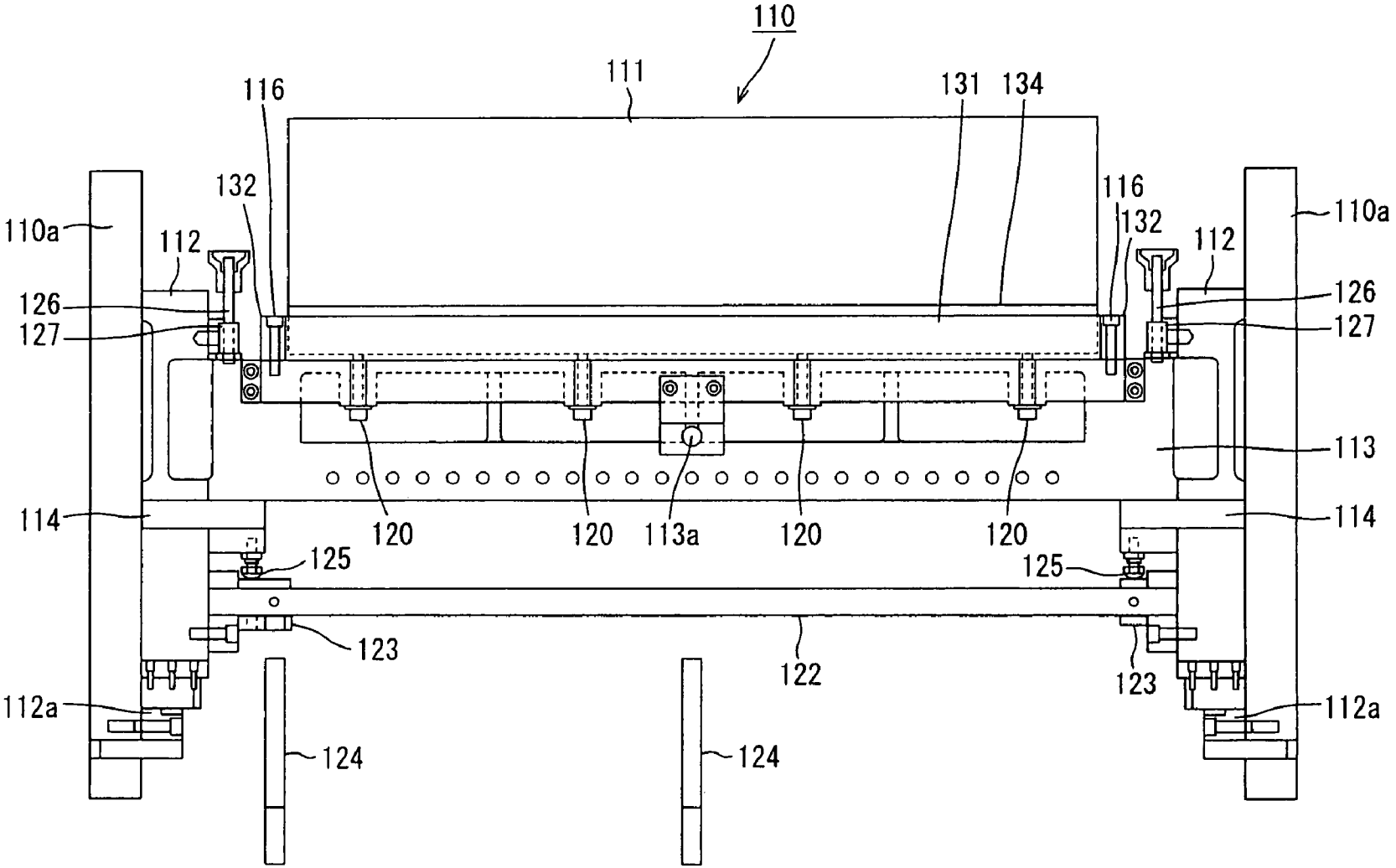
FIG. 8 is a rear view of FIG. 6.
Figure 9:
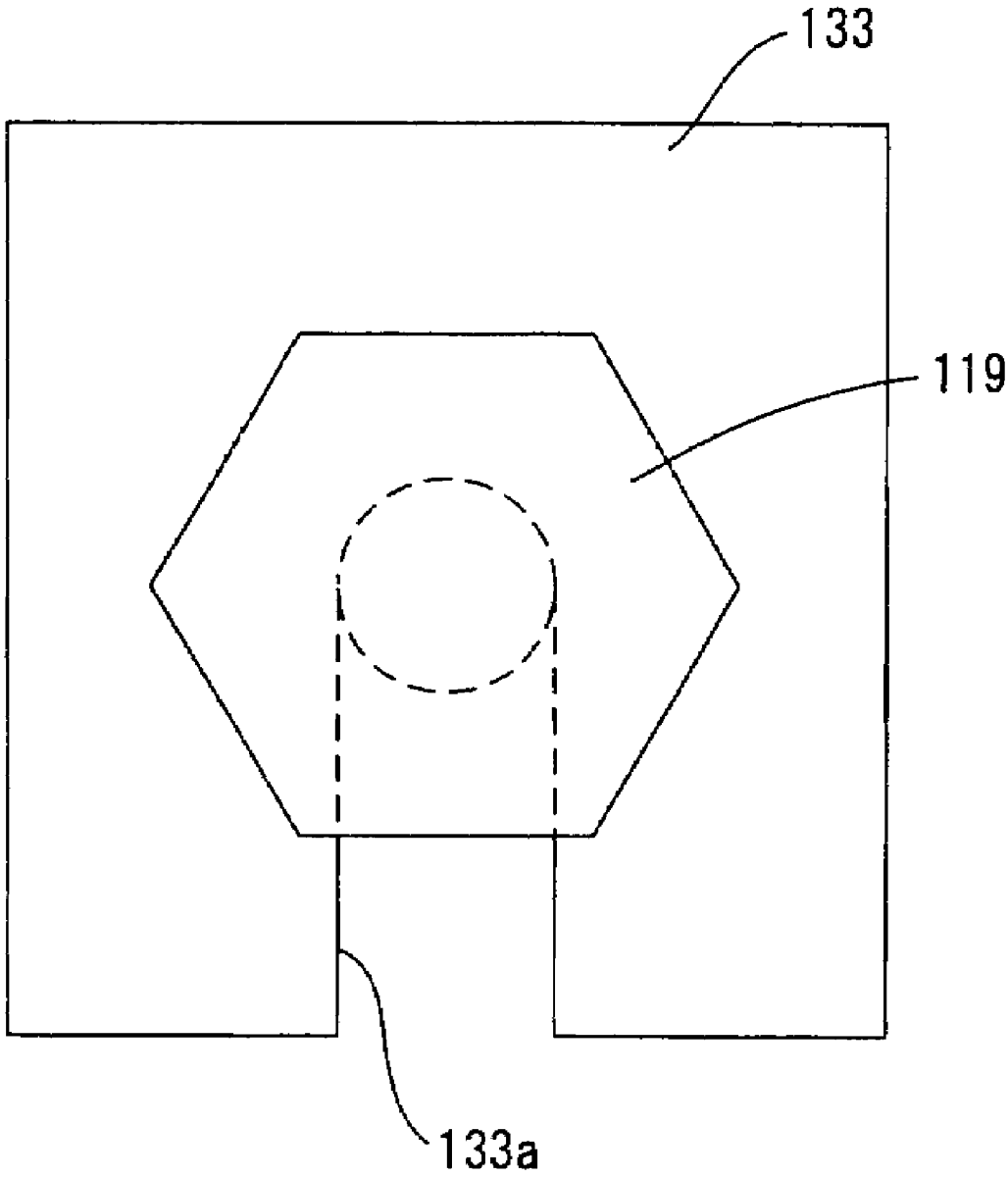
FIG. 9 is a view as viewed in the direction of arrow IX of FIG. 6.

As shown in FIGS. 2 and 6, distal ends of hydraulic cylinders 128 are connected to the corresponding movable frames 112. Adjustment screws 129, which are rotatably supported by the corresponding frames 110*a*, are screw-engaged with corresponding proximal ends of the hydraulic cylinders 128.

In the case where the wall plates 115 and the bottom plate 117 are attached onto the support bed 113, the rods of the hydraulic cylinders 128 are expanded or retracted to thereby slide the movable frames 112 (in the A–B direction in FIGS. 2 and 6) in relation to the corresponding frames 110*a* via the corresponding guide members 112*a*, whereby the ink fountain roller 111 can be moved toward or away from the ink form roller 33*d*.

In the case where the ink collection pan 131 is attached onto the support bed 113, the operation rods 124 are fitted into the corresponding eccentric sleeves 123. Then, by use of the fitted operation rods 124, the rotative shaft 122 is rotated. As a result, the eccentric sleeves 123 are rotated eccentrically in relation to the axis of the rotative shaft 122, thereby pivotally moving the support bed 113 about the support shaft 114. The pivotal movement of the support bed 113 changes the angular position (the angle of inclination) of the upper surface of the support bed 113, whereby the distal end of the doctor blade 134 can be moved toward or away from the ink fountain roller 111. By use of the adjustment screws 121, the condition of contact of the distal end of the doctor blade 134 with the ink fountain roller 111 can be adjusted.

As shown in FIGS. 2 and 6, an oscillating roller 39*d* is disposed in the vicinity of the ink fountain roller 111. The oscillating roller 39*d* is rotatably supported via unillustrated eccentric bearings. The oscillating roller 39*d* can be positioned as follows: in the case where the wall plates 115 and the bottom plate 117 are attached onto the support bed 113 of the ink unit 110, the oscillating roller 39*d* is positioned in contact with the ink fountain roller 111 (see FIG. 2); and in the case where the ink collection pan 131 is attached onto the support bed 113 of the ink unit 110, the oscillating roller 39*d* is positioned away from the ink fountain roller 111 (see FIG. 6).

In the present embodiment, the wall plates 115, the bottom plate 117, and other members constitute an ink fountain according to the present invention; the rotative shaft 122, the eccentric sleeves 123, the operation rods 124, the bolts 125, and other members constitute second support-bed-retaining means according to the present invention; the position-fixing screws 126, the female-threaded members 127, and other members constitute first support-bed-retaining means according to the present invention; the ink collection pan 131, the doctor blade 134, and other members constitute pre-wiping means according to the present invention. However, no particular limitation is imposed on members used to constitute the ink fountain and these means. Any members may be used so long as they yield actions and effects similar to those of the above-described members of the present embodiment.

Next will be described operation of the thus-configured intaglio printing press of the present embodiment.

In the case of performing 4-color printing (multicolor printing) without pre-wiping, first, the wall plates 115 and the bottom plate 117 are attached onto the support bed 113 of the ink unit 110 as described above. The support bed 113 is pivotally moved such that its upper surface is inclined at a predetermined major angular position (a position for supplying ink to the ink fountain roller 111). The support bed 113 is fixedly retained at the position. By means of the adjustment screws 121, the condition of contact of the distal end of the bottom plate 117 with the ink fountain roller 111 is adjusted. The oscillating roller 39*d* is positioned to come into contact with the ink fountain roller 111.

The sheet feeder 10 feeds the sheet 1 onto the sheet feeder table 21. The swing arm shaft pregripper 22 transfers the sheet 1 to the transfer cylinder 23. The sheet 1 is then transferred to the impression cylinder 31 via a transfer cylinder 24. The ink fountain units 34*a* to 34*c* and the ink unit 110 feed ink to the intaglio cylinder 32 via the ink form rollers 33*a* to 33*d*, respectively. The wiping roller 37 removes excess ink from the intaglio cylinder 32, and then ink is transferred to the sheet 1 held on the impression cylinder 31 to thereby perform 4-color printing on the sheet 1. Subsequently, the sheet 1 is transferred from the impression cylinder 31 to the delivery cylinder 41. The sheet 1 undergoes gripping change from the delivery cylinder 41 to a gripper bar of the chain 44. The sheet 1 is transported on the chain 44 as the chain 44 is run by means of rotation of the sprockets 42 and 43. The thus-printed sheets 1 are delivered onto delivery units 45.

When three-color printing (ordinary printing) with pre-wiping is to be performed, the position-fixing screws 126 engaged with the corresponding female-threaded members 127 are loosened to be disengaged from the support bed 113 of the ink unit 110. The distal end of the bottom plate 117 is moved away from the ink fountain roller 111. The wall plates 115 and the bottom plate 117 are removed from the support bed 113. The ink collection pan 131 is attached onto the support bed 113 as mentioned previously. The support bed 113 is pivotally moved such that its upper surface is inclined at a predetermined minor angular position (a position for collecting ink from the ink fountain roller 111), and is retained at the position in the previously mentioned condition. The operation rods 124 are fitted into the corresponding eccentric sleeves 123 and operated to bring the distal end of the doctor blade 134 into contact with the ink fountain roller 111. By means of the adjustment screws 121, the condition of contact of the distal end of the doctor blade 134 with the ink fountain roller 111 is adjusted. The oscillating roller 39*d* is positioned so as to separate from the ink fountain roller 111.

The sheet feeder 10 feeds the sheet 1 onto the sheet feeder table 21. The swing arm shaft pregripper 22 transfers the sheet 1 to the transfer cylinder 23. The sheet 1 is then transferred to the impression cylinder 31 via the transfer cylinder 24. The ink fountain units 34*a* to 34*c* feed ink to the intaglio cylinder 32 via the ink form rollers 33*a* to 33*c*, respectively. The doctor blade 134 provided on the support bed 113 of the ink unit 110 scrapes most of excess ink from the intaglio cylinder 32 to thereby collect ink in the ink collection pan 131. Subsequently, the wiping roller 37 removes slightly remaining excess ink from the intaglio cylinder 32, and then ink is transferred to the sheet 1 held on the impression cylinder 31 to thereby perform 3-color printing on the sheet 1. Subsequently, the sheet 1 is transferred from the impression cylinder 31 to the delivery cylinder 41. The sheet 1 undergoes gripping change from the delivery cylinder 41 to a gripper bar of the chain 44. The sheet 1 is transported on the chain 44 as the chain 44 is run by means of rotation of the sprockets 42 and 43. The thus-printed sheets 1 are delivered onto delivery units 45.

The intaglio printing press of the present embodiment includes the ink unit 110 that allows selective provision of a set of the wall plates 115, the bottom plate 117, and other members or a set of the ink collection plate 131 and other members. Specifically, when the wall plates 115, the bottom plate 117, and other members are provided on the support bed 113, the ink fountain roller 111 can supply ink to the intaglio cylinder 32, thereby enabling 4-color printing (multicolor printing) without pre-wiping. When the ink collection plate 131 and other members are provided on the support bed 113, the ink fountain roller 111 can collect ink from the intaglio cylinder 32, thereby enabling 3-color printing (ordinary printing) with pre-wiping.

Thus, the intaglio printing press of the present embodiment can perform both 3-color printing (ordinary printing) with pre-wiping and 4-color printing (multicolor printing) without pre-wiping, so that, when a user is to purchase an intaglio printing press, the user does not need to select either a function of 3-color printing (ordinary printing) with pre-wiping or a function of 4-color printing (multicolor printing) without pre-wiping.

Also, the same members 116, 119, and 120 can be used to attach the wall plates 115 and the bottom plate 117 to the support bed 113 of the ink unit 110 and to attach the ink collection pan 131 to the support bed 110. In other words, the same attachment structure is employed for attaching the ink fountain to the support bed 113 and for attaching the pre-wiping means to the support bed 113, thereby suppressing production cost and facilitating the work of changing the ink fountain to and from the pre-wiping means.

Also, since the intaglio cylinder 32 is a triple-diameter cylinder, application of sufficient printing pressure is facilitated in contrast to the case of employment of a double-diameter cylinder where application of sufficient printing pressure is difficult; and the size of a printing press can be reduced in contrast to the case of employment of a quadruple-diameter cylinder where the size of a printing press increases.

Figure 10:
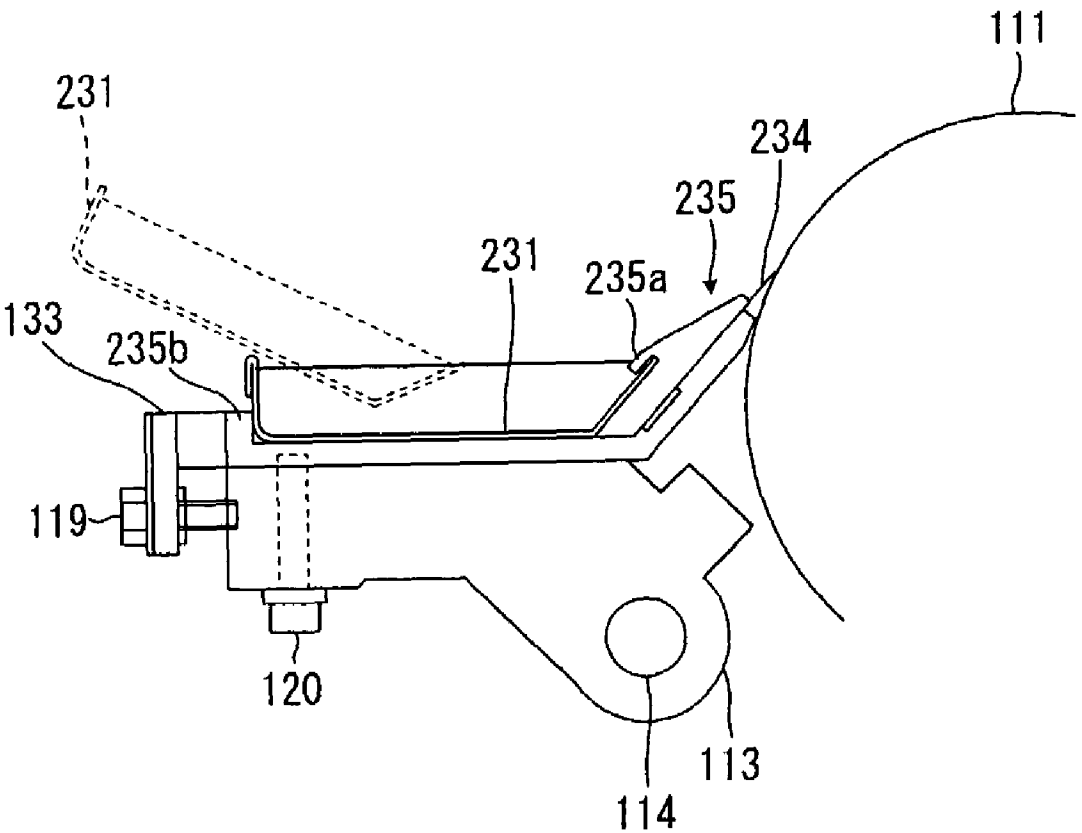
FIG. 10 is a schematic view showing the configuration of a main portion of another embodiment of an intaglio printing press according to the present invention.

In the present embodiment, the ink collection pan 131 integrally provided with the doctor blade 134 is attached to the support bed 113. However, the present invention is not limited thereto. For example, as shown in FIG. 10, an ink collection pan 231 and an attachment bed 235 may be provided. The attachment bed 235 has a front-end engagement portion 235*a* and a rear-end engagement portion 235*b*; is unitarily provided with a doctor blade 234; and is removably attached onto the support bed 113. The front-end engagement portion 235*a* is removably engaged with a front end portion of the ink collection pan 231, and the rear-end engagement portion 235*b* is removably engaged with a rear end portion of the ink collection pan 231. In other words, the ink collection pan 231 is removably supported in relation to the doctor blade 234, so that the ink collection pan 231 can be readily attached or detached without use of a tool or the like. Thus, ink collected in the ink collection pan 231 can be efficiently disposed of.

In the present embodiment, a set of the wall plates 115 and the bottom plate 117 or a set of the ink collection pan 131 and the doctor blade 134 is selectively attached onto the support bed 113. However, the present invention is not limited thereto. For example, a support bed to which wall plates and a bottom plate are attached, and a support bed to which an ink collection pan and a doctor blade are attached may be interchangeably mounted on the support shaft 114.

Figure 11:
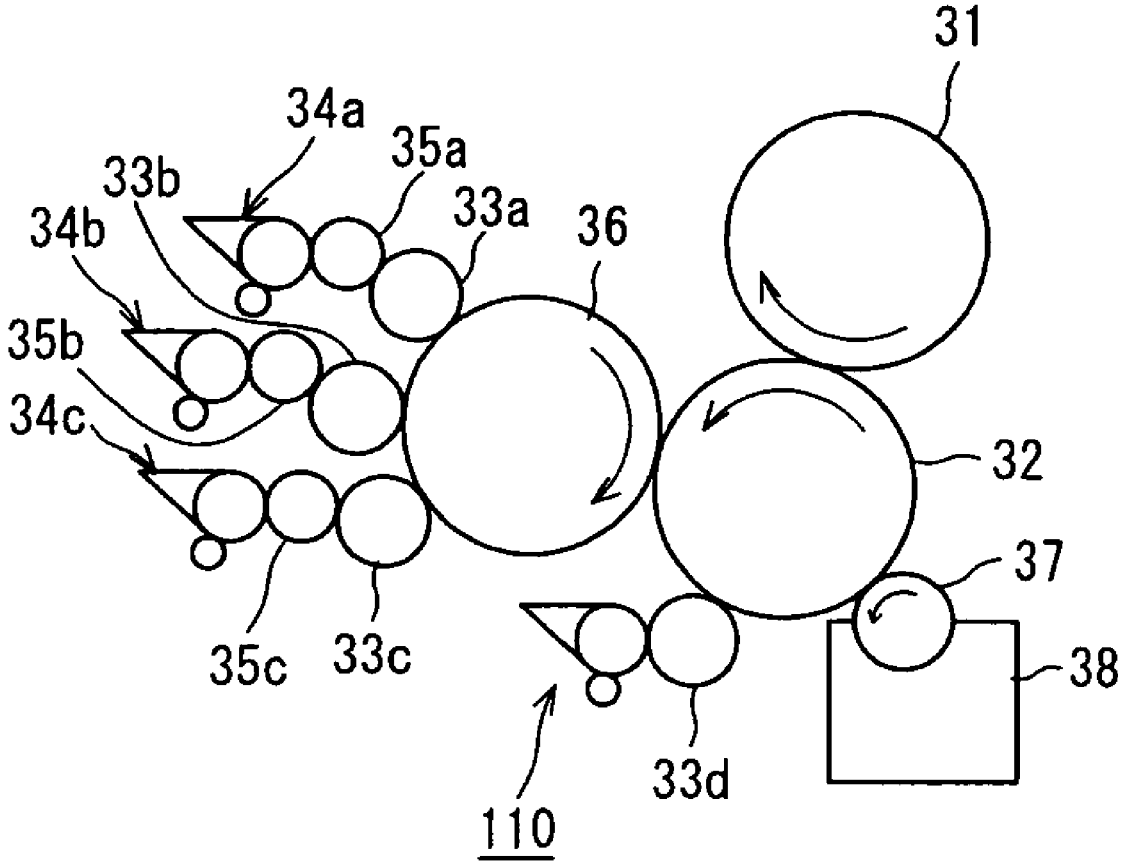
FIG. 11 is a schematic view showing the configuration of a main portion of still another embodiment of an intaglio printing press according to the present invention.
Figure 12:
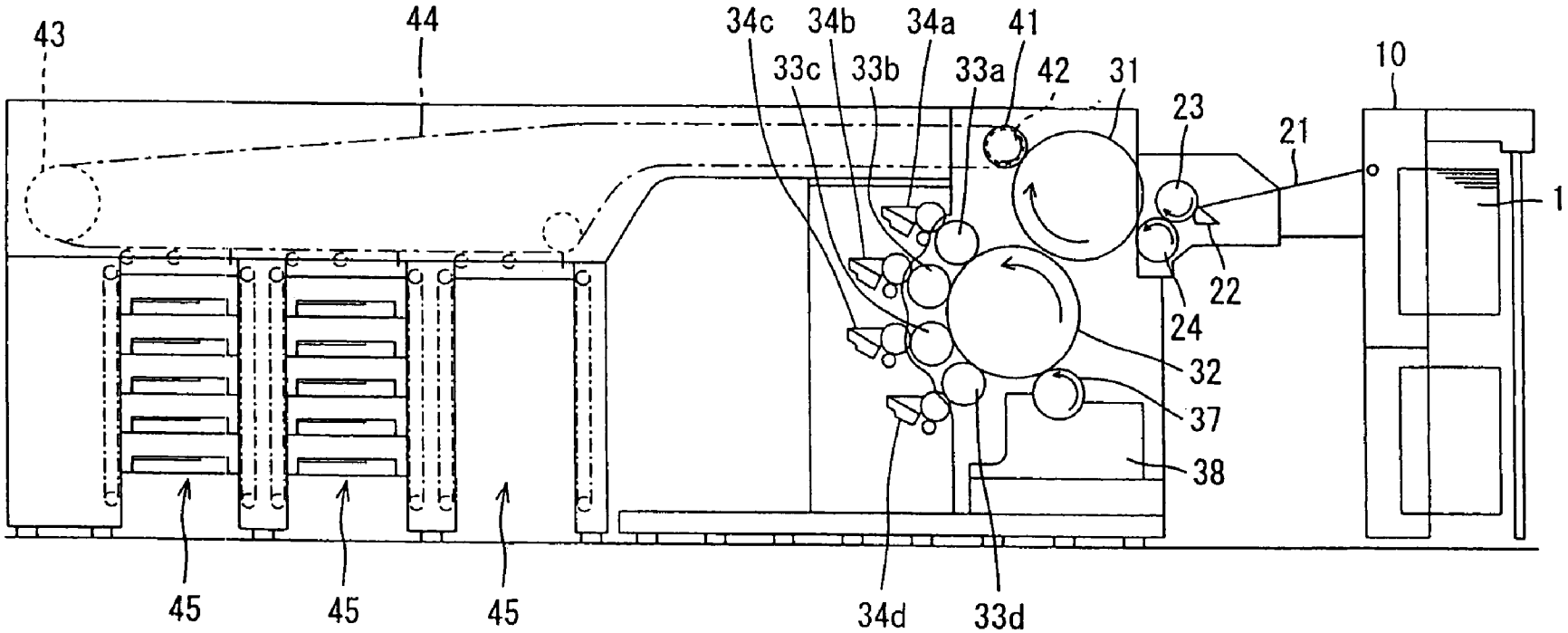
FIG. 12 is a schematic view showing the configuration of a conventional intaglio printing press.

In the present embodiment, the ink form rollers 33*a* to 33*c* abut the outer circumferential surface of the intaglio cylinder 32. However, the present invention is not limited thereto. For example, as shown in FIG. 11, the ink form rollers 33*a* to 33*c* may indirectly abut the outer circumferential surface of the intaglio cylinder 32 via a collective ink cylinder 36. In other words, the ink unit 110 may be disposed downstream of the collective ink roller 36 and upstream of the wiping roller 37 with respect to the rotational direction of the intaglio cylinder 32. In FIG. 11, reference numerals 35*a* to 35*c* denote intermediate rollers.

The above embodiment is described while mentioning an intaglio printing press that performs 4-color printing (multicolor printing) without pre-wiping and 3-color printing (ordinary printing) with pre-wiping. However, the present invention is not limited thereto. The present invention can be applied to an intaglio printing press that performs multicolor printing (printing in n colors (n: 2 or greater integers) without pre-wiping and fewer-color printing (printing in n–1 colors) with pre-wiping; for example, an intaglio printing press that performs 3-color printing (multicolor printing) without pre-wiping and 2-color printing (fewer-color printing) with pre-wiping, and an intaglio printing press that performs 2-color printing (multicolor printing) without pre-wiping and 1-color printing (fewer-color printing) with pre-wiping.

What is claimed is:

1. An intaglio printing press, comprising:

a rotatably supported intaglio cylinder; and wiping means for removing excess ink from said intaglio cylinder;

a rotatably supported roller;

one of an ink fountain for supplying ink to said roller, and pre-wiping means for collecting ink through contact with said roller provided selectively, wherein, the rotatably supported roller is selectively engaged with said selected one of the ink fountain and pre-wiping means such that when said ink fountain is provided, said roller supplies ink to said intaglio cylinder, and when said pre-wiping means is provided, said roller collects ink from said intaglio cylinder.

2. An intaglio printing press according to claim 1, further comprising:

a support member that selectively supports one of said ink fountain and said pre-wiping means.

3. An intaglio printing press according to claim 2, wherein said ink fountain and said pre-wiping means use a same attachment structure for attachment to said support member.

4. An intaglio printing press according to claim 3, wherein said same attachment structure includes, a lock bolt extending through said support member and engaged with said one of said ink fountain and said pre-wiping means, and a lock screw engaged with a groove formed in said one of said ink fountain and in said pre-wiping means, and screw-engaged with said support member.

5. An intaglio printing press according to claim 4, wherein said same attachment structure further includes, a fixing bolt extending through said one of said ink fountain and said pre-wiping means, and screw-engaged with said support member.

6. An intaglio printing press according to claim 2, wherein said support member is a support bed supported in a pivotally movable condition by a frame of said intaglio printing press.

7. An intaglio printing press according to claim 6, further comprising:

first support-bed-retaining means for, when said ink fountain is provided on said support bed, retaining said ink fountain at a position where ink is supplied from said ink fountain to said roller; and second support-bed-retaining means for, when said pre-wiping means is provided on said support bed, retaining said pre-wiping means at a position where ink is collected from said roller.

8. An intaglio printing press according to claim 7, wherein said pre-wiping means includes, a blade for scraping ink from said roller through contact with said roller, and an ink collection pan for collecting ink scraped off by means of said blade, said second support-bed-retaining means includes:

a rotatably supported rotative shaft, and an eccentric sleeve unitarily fitted to said rotative shaft and adapted to support said support bed thereon, and said blade adapted to be moved toward or away from said roller for positional adjustment by means of rotation of said rotative shaft.

9. An intaglio printing press according to claim 1, wherein said pre-wiping means includes, a blade for scraping ink from said roller through contact with said roller, and an ink collection pan for collecting ink scraped off by means of said blade.

10. An intaglio printing press according to claim 9, wherein said ink collection pan is supported in such a manner as to be removable from said blade.

11. An intaglio printing press according to claim 10, wherein said pre-wiping means further includes an attachment bed unitarily provided with said blade and having a front-end engagement portion and a rear-end engagement portion, a front end portion of said ink collection pan being removably engaged with said front-end engagement portion, and a rear end portion of said ink collection pan being removably engaged with said rear-end engagement portion.

12. An intaglio printing press according to claim 1, wherein said intaglio printing press has a printing point located downstream of said wiping means with respect to a rotational direction of said intaglio cylinder and at which printing is performed, and an ink supply/collection point located on said intaglio cylinder and downstream of said printing point with respect to the rotational direction of said intaglio cylinder, at which, when said ink fountain is provided, said roller supplies ink to said intaglio cylinder, and at which, when said pre-wiping means is provided, said roller collects ink from said intaglio cylinder; and said intaglio printing press further comprises ink supply means provided downstream of said printing point and upstream of said ink supply/collection point with respect to the rotational direction of said intaglio cylinder.

13. An intaglio printing press according to claim 1, further comprising:

a plurality of ink supply means provided upstream of said wiping means with respect to a rotational direction of said intaglio cylinder and adapted to supply ink to said intaglio cylinder; and ink means provided downstream of said ink supply means located furthest downstream with respect to the rotational direction of said intaglio cylinder, and upstream of said wiping means with respect to the rotational direction of said intaglio cylinder, said ink means being configured such that when said ink fountain is provided said roller supplies ink to said intaglio cylinder, and such that when said pre-wiping means is provided said roller collects ink from said intaglio cylinder.

14. An intaglio printing press according to claim 1, further comprising:

a collective ink cylinder provided upstream of said wiping means with respect to a rotational direction of said intaglio cylinder;

a plurality of ink supply means for supplying ink to said intaglio cylinder via said collective ink cylinder; and ink means provided downstream of said collective ink cylinder and upstream of said wiping means with respect to the rotational direction of said intaglio cylinder, said ink means being configured such that when said ink fountain is provided said roller supplies ink to said intaglio cylinder, such that when said pre-wiping means is provided said roller collects ink from said intaglio cylinder.

15. An intaglio printing press according to any one of claims 12 to 14, wherein three ink supply means are provided.

16. An intaglio printing press according to claim 1, wherein said intaglio cylinder is a triple-diameter cylinder.

* * * * *